US010883217B2

(12) United States Patent
Xi et al.

(10) Patent No.: US 10,883,217 B2
(45) Date of Patent: Jan. 5, 2021

(54) WASHING MACHINE INNER CYLINDER ASSEMBLY AND DRUM-TYPE WASHING MACHINE

(71) Applicant: TCL HOME APPLIANCES (HEFEI) CO., LTD., Hefei (CN)

(72) Inventors: Lei Xi, Hefei (CN); Wengen Xu, Hefei (CN); Benyang Bian, Hefei (CN)

(73) Assignee: TCL HOME APPLIANCES (HEFEI) CO., LTD., Hefei (CN)

( * ) Notice: Subject to any disclaimer, the term of this patent is extended or adjusted under 35 U.S.C. 154(b) by 263 days.

(21) Appl. No.: 15/576,726

(22) PCT Filed: Feb. 25, 2016

(86) PCT No.: PCT/CN2016/074530

§ 371 (c)(1),
(2) Date: Nov. 24, 2017

(87) PCT Pub. No.: WO2017/143552

PCT Pub. Date: Aug. 31, 2017

(65) Prior Publication Data

US 2018/0163334 A1 Jun. 14, 2018

(51) Int. Cl.
*D06F 37/20* (2006.01)
*D06F 39/00* (2020.01)
(Continued)

(52) U.S. Cl.
CPC ..... *D06F 37/20* (2013.01); *D06F 37/12* (2013.01); *D06F 39/00* (2013.01); *D06F 37/00* (2013.01); *D06F 37/22* (2013.01)

(58) Field of Classification Search
CPC ..... D06F 37/00; D06F 37/04; D06F 37/12; D06F 37/20; D06F 37/22; D06F 37/26; D06F 37/264; D06F 37/267; D06F 37/269
See application file for complete search history.

(56) References Cited

U.S. PATENT DOCUMENTS 8,650,918 B2 * 2/2014 McMaster ..... D06F 37/12 68/140
9,080,279 B2 * 7/2015 Jun ..... H02K 21/12
(Continued)

FOREIGN PATENT DOCUMENTS

CN 2612701 Y 4/2004
CN 2718010 Y 8/2005
(Continued)

*Primary Examiner* — Joseph L. Perrin
(74) *Attorney, Agent, or Firm* — Winston Hsu

(57) ABSTRACT

The preset disclosure provides a washing machine inner cylinder assembly and a drum-type washing machine. The washing machine inner cylinder assembly includes an inner cylinder, a support, a rotation shaft, a cover, and a sealing strip. The support includes a hub portion and a leg portion extending outwards from periphery of hub portion. End of rotation shaft is fixedly embedded in a shaft hole of hub portion. The inner cylinder includes a cylinder body and a cylinder bottom at an end of cylinder body. A groove is defined in outer surface of cylinder bottom for receiving and clamping the leg portion. The cover covers and connects to the support. The sealing strip is arranged between the cover and cylinder bottom. The sealing strip, the cover, and the groove cooperatively define a closed space for receiving the support.

10 Claims, 16 Drawing Sheets

(51) Int. Cl.

| | |
|---|---|
| ***D06F 37/12*** | (2006.01) |
| *D06F 37/22* | (2006.01) |
| *D06F 37/00* | (2020.01) |

(56) References Cited

U.S. PATENT DOCUMENTS

| | | | | |
|---|---|---|---|---|
| 9,512,551 | B2 * | 12/2016 | Jun | D06F 37/304 |
| 2006/0179897 | A1 * | 8/2006 | Saito | D06F 37/04 68/23 R |
| 2008/0178635 | A1 * | 7/2008 | Ratfisch | D06F 37/04 68/140 |
| 2009/0133447 | A1 * | 5/2009 | Yoon | D06F 37/02 68/23.1 |
| 2017/0298551 | A1 * | 10/2017 | Lv | D06F 37/266 |

FOREIGN PATENT DOCUMENTS

| | | | | |
|---|---|---|---|---|
| CN | 1779043 | A | 5/2006 | |
| CN | 1973078 | A | 5/2007 | |
| CN | 101139795 | A | 3/2008 | |
| CN | 201236285 | Y | 5/2009 | |
| CN | 102414359 | A | 4/2012 | |
| CN | 203346669 | U | 12/2013 | |
| CN | 104040064 | A | 9/2014 | |
| CN | 105088617 | A | 11/2015 | |
| CN | 105525481 | A | 4/2016 | |
| EP | 2 270 273 | A1 | 1/2011 | |
| GB | 2253861 | A * | 9/1992 | D06F 37/206 |

* cited by examiner

WASHING MACHINE INNER CYLINDER ASSEMBLY AND DRUM-TYPE WASHING MACHINE

CROSS REFERENCE TO RELATED APPLICATION

This application is a National Stage Entry of International Application No. PCT/CN2016/074530, filed Feb. 25, 2016.

BACKGROUND OF THE INVENTION

1. Field of the Invention

The subject matter relates to washing machines, and more particularly, to a washing machine inner cylinder assembly and a drum-type washing machine.

2. Description of the Prior Art

Nowadays, a drum-type washing machine commercially available mainly includes a casing, an outer cylinder and an inner cylinder received in the casing, and a support fixed to an outer surface of the bottom of the inner cylinder. The support usually includes a hub portion and a number of leg portions connected to the hub portion. Each leg portion is connected to the inner cylinder by screws. The hub portion of the support is connected to a rotation shaft. The rotation shaft is connected to a motor to deliver rotating force.

The support is usually made of aluminum alloy. The leg portion has a cross section of slot-shaped, and the opening of the slot faces away from the bottom of the inner cylinder. Thus, stains often stimulate in the slots of the leg portions and the gap between the leg portions and the bottom of the inner cylinder, which cause sanitary problems.

In addition, the support can be easily oxidized owing to its material. Thus, the support may undergo a chemical reaction that causes corrosion when the support contacts with the cleaning agent during repeatedly uses, which further deteriorates the sanitary situation in the inner cylinder. Furthermore, strength failure happens, and cracks may generate in the leg portions.

SUMMARY OF THE INVENTION

A main object of the present disclosure is to provide a washing machine inner cylinder assembly, to improve the sanitary situation in the washing machine.

To achieve that, the present disclosure provides a washing machine inner cylinder assembly comprising an inner cylinder, a support, a rotation shaft, a cover, and a sealing strip.

Wherein the support comprises a hub portion and a leg portion extending outwards from a periphery of the hub portion, an end of the rotation shaft is fixedly embedded in a shaft hole of the hub portion.

Wherein the inner cylinder comprises a cylinder body and a cylinder bottom positioned at an end of the cylinder body, a groove is defined in an outer surface of the cylinder bottom for receiving and clamping the leg portion.

Wherein the cover covers the support, the sealing strip is arranged between the cover and the cylinder bottom, the sealing strip, the cover, and the groove cooperatively define a closed space for receiving the support.

Preferably, the support comprises a plurality of leg portions, the leg portions radially extend from the hub portion on a single plane, and the leg portions are equally arranged along the periphery of the hub portion.

Preferably, the support comprises connecting plates for connecting each two adjacent leg portions, and the connecting plates defines first connecting holes for connecting the cover.

Preferably, an outer surface of the cover is attached to an outer surface of the cylinder bottom.

Preferably, the groove comprises a bottom surface, two side walls connected to two sides of the bottom surface, and an end wall facing an end surface of the leg portion.

Preferably, the sealing strip comprises first sections and second sections, the sealing strip surrounds an outer periphery of the support, the first section is elastically abutted against the end wall, and the second section is elastically abutted against the side wall.

Preferably, edges of the cover comprise top plates which are bar-shaped, the top plate has a lengthwise direction along a periphery of the cylinder body, and a width direction along the axial direction of the cylinder body, a first rib protrudes from a surface of the top plate facing a sidewall of the cylinder body, the first rib extends along the periphery of the cylinder body, and the first section is positioned between the first rib and the top plate.

Preferably, the cover further comprises a second rib which is parallel to and spaced from the first rib, and the first section is clamped between the first rib and the second rib.

Preferably, third ribs protrude from an inner surface of the cover, the third ribs are set along a lengthwise direction of the leg portions, and are spaced from edges of the cover, and the second section is positioned between the third rib and the edge of the cover adjacent to the third rib.

Preferably, wherein fourth ribs protrude from the inner surface of the cover, the fourth ribs are parallel to and spaced from the third ribs, the fourth rib is positioned between the third rib and the edge of the cover, and the second section defines a latching notch for receiving the fourth rib.

Preferably, wherein the cover defines a through hole which surrounds the rotation shaft, the through hole matches the rotation shaft while sealing is obtained therebetween, the washing machine inner cylinder assembly further comprises a sealing cushion ring around the rotation shaft, an annular shoulder protrudes from an inner surface of the cover, and the sealing cushion ring is elastically abutted against and positioned between the annular shoulder and an outer surface of the rotation shaft.

The present disclosure further provides a drum-type washing machine comprising a washing machine inner cylinder assembly, the washing machine inner cylinder assembly comprises an inner cylinder, a support, a rotation shaft, a cover, and a sealing strip.

Wherein the support comprises a hub portion and a leg portion extending outwards from a periphery of the hub portion, an end of the rotation shaft is fixedly embedded in a shaft hole of the hub portion;

Wherein the inner cylinder comprises a cylinder body and a cylinder bottom positioned at an end of the cylinder body, a groove is defined in an outer surface of the cylinder bottom for receiving and clamping the leg portion;

Wherein the cover covers the support, the sealing strip is arranged between the cover and the cylinder bottom, the sealing strip, the cover, and the groove cooperatively define a closed space for receiving the support.

Preferably, the support comprises a plurality of leg portions, the leg portions radially extend from the hub portion on a single plane, and the leg portions are equally arranged along the periphery of the hub portion.

Preferably, the support comprises connecting plates for connecting each two adjacent leg portions, and the connecting plates defines first connecting holes for connecting the cover.

Preferably, an outer surface of the cover is attached to an outer surface of the cylinder bottom.

Preferably, the groove comprises a bottom surface, two side walls connected to two sides of the bottom surface, and an end wall facing an end surface of the leg portion.

Preferably, the sealing strip comprises first sections and second sections, the sealing strip surrounds an outer periphery of the support, the first section is elastically abutted against the end wall, and the second section is elastically abutted against the side wall.

Preferably, edges of the cover comprise top plates which are bar-shaped, the top plate has a lengthwise direction along a periphery of the cylinder body, and a width direction along the axial direction of the cylinder body, a first rib protrudes from a surface of the top plate facing a sidewall of the cylinder body, the first rib extends along the periphery of the cylinder body, and the first section is positioned between the first rib and the top plate.

Preferably, the cover further comprises a second rib which is parallel to and spaced from the first rib, and the first section is clamped between the first rib and the second rib.

Preferably, the cover defines a through hole which surrounds the rotation shaft, the through hole matches the rotation shaft while sealing is obtained therebetween, the washing machine inner cylinder assembly further comprises a sealing cushion ring around the rotation shaft, an annular shoulder protrudes from an inner surface of the cover, and the sealing cushion ring is elastically abutted against and positioned between the annular shoulder and an outer surface of the rotation shaft.

In the above washing machine inner cylinder assembly, the support is sealed between the cover and the inner cylinder, thereby preventing the support from generating corrosion when the support directly contacts with the cleaning agent or water, and also preventing stains from stimulating in the slots of the supporting legs. Thus, the sanitary situation in the inner cylinder can be improved.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the views.

DETAILED DESCRIPTION

Figure 1:
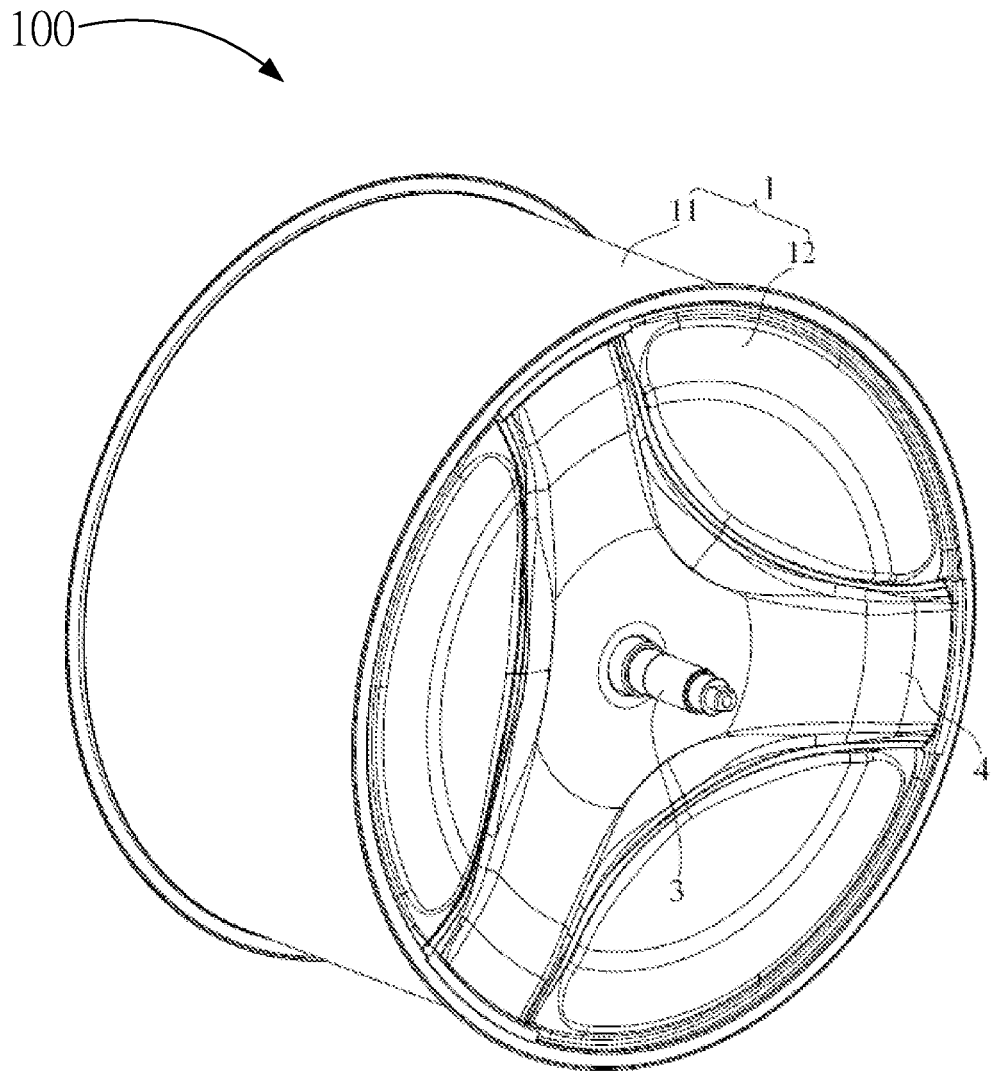
FIG. 1 is an isometric view of an embodiment of a washing machine inner cylinder assembly of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein.

Note that all directional descriptions in the embodiment (such as top, bottom, left, right, front, back, and so on) are only used to explain the relative position relationships and movement of different components under a specific posture (as shown in the drawings). When the specific posture is changed, the directional descriptions are also changed accordingly.

In addition, descriptions of the "first" and "second" in the embodiments are only used for describing purpose, but cannot be interpreted as descriptions or hints about the relative importance or the number of technical features. Thus, the feature limited by "first" and "second" can be interpreted as descriptions or hints that including at least one of the feature. In addition, various technical solutions of different embodiments can be combined, based on knowledge of one having ordinary skill in the art. When there is conflict after combination of the technical solutions or the combination cannot be achieved, it can be understood that the combination of technical solutions does not exist, and it shall not fall within the scope of the present disclosure.

Figure 2:
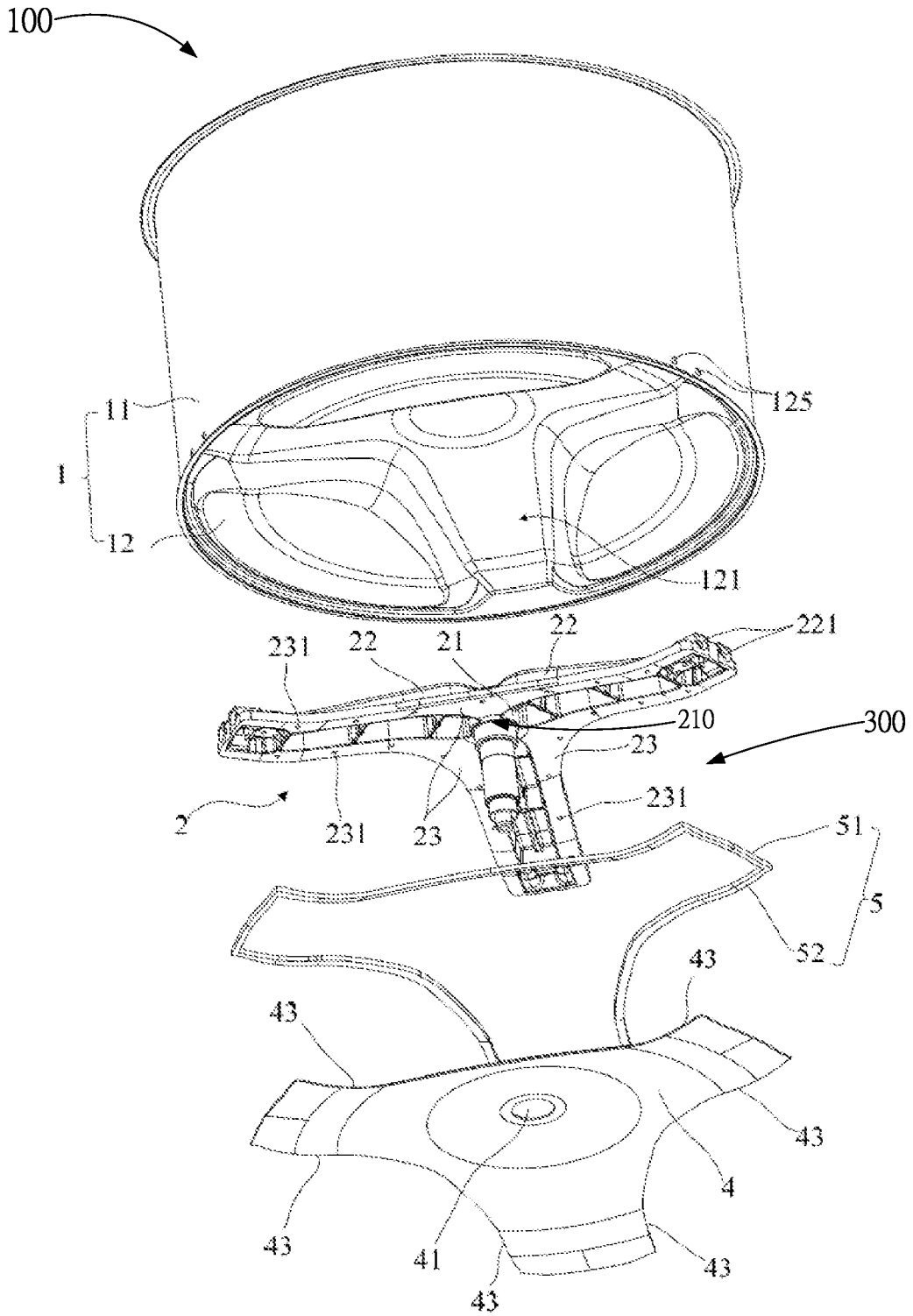
FIG. 2 is a partially disassembled isometric view of the washing machine inner cylinder assembly of FIG. 1.

The present disclosure provides a washing machine inner cylinder assembly 100. Referring to FIGS. 1 and 2, in one embodiment, the washing machine inner cylinder assembly 100 comprises an inner cylinder 1, a support 2, and a rotation shaft 3. The washing machine inner cylinder assembly 100 further comprises a cover 4 and a sealing strip 5.

The support 2 comprises a hub portion 21 and a leg portion 22 extending outwards from a periphery of the hub portion 21. An end of the rotation shaft 3 is fixedly embedded in a shaft hole 210 of the hub portion 21.

The inner cylinder 1 comprises a cylinder body 11 and a cylinder bottom 12. The cylinder bottom 12 is positioned at an end of the cylinder body 11. A groove 121 is defined in an outer surface of the cylinder bottom 12 for receiving and clamping the leg portion 22.

The cover 4 covers the support 2. The sealing strip 5 is arranged between the cover 4 and the cylinder bottom 12. The sealing strip 5, the cover 4, and the groove 121 cooperatively define a closed space 300 for receiving the support 2.

In this embodiment, the support 2 is an aluminum casting, and is fixed to the outer surface of the cylinder bottom 12. To save materials and decrease weight, the leg portion 22 has a cross-section of slot-shaped, that is, the leg portion 22 is hollow. In addition, to ensure the strength of the leg portion 22, a number of reinforcement ribs are set in the leg portion 22. Generally, the number of the leg portion(s) 22 is associated with the volume of the inner cylinder 1, that is, the larger of the volume of the inner cylinder 1, the greater of the number of the leg portion(s) 22. The leg portions 22 usually numbers three or four.

The inner cylinder 1 is usually made of stainless steel. The cylinder body 11 is cylindrical, with openings at two ends thereof. The cylinder body 11 is connected to the cylinder bottom 12 by revolving-riveting. The number of the groove(s) 121 corresponds to the number of the leg portion (s) 22. When a number of the leg portions 22 are involved, a number of the grooves 121 interconnect at a connecting point adjacent to the hub portion 21.

The cover 4 has a thin-wall structure, and is made by injection molding. Preferably, the shape of the cover 4 matches the shape of the support 2. To ensure that the cover 4 can totally covers the support 2, the size of the cover 4 can be slightly larger than the size of the support 2.

The sealing strip 5 is for sealing purpose. The sealing strip 5 should have a good deformation capability, and can be made of rubber or silicone. The sealing strip 5 can seal the gap between the cover 4 and the cylinder bottom 12, and can facilitate the disassembly between the cover 4 and the cylinder bottom 12.

In the existing washing machine inner cylinder assembly, dead angles are easily formed between the slots of the leg portions 22 and the reinforcement ribs. When the leg portions 22 are directly immersed in the cleaning agent and/or the water, stains are easily stimulated in the dead angles, which create bacteria and cause sanitary problems. The sanitary problems cannot be solved by cleaning agent or high temperature sterilization.

Since the support 2 is made of aluminum alloy, corrosion is easily generated when the support 2 contacts with the cleaning agent and/or water during repeatedly uses, which further stimulates stains and causes pollution. Modifying the ratio of the aluminum alloy in the support 2 may work to a certain extent, but cannot completely prevent the aluminum alloy from generating corrosion.

In the present disclosure, the support 2 is sealed between the cover 4 and the inner cylinder 1, thereby preventing the support 2 from generating corrosion when the support 2 directly contacts with the cleaning agent and/or water, and also preventing stains from stimulating in the slots of the supporting legs 22. Thus, the sanitary situation in the inner cylinder 1 can be improved.

Furthermore, referring to FIGS. 1, 3, 5, 7, 11 and 12, in one embodiment, the support 2 comprises a number of leg portions 22. The leg portions 22 radially extend from the hub portion 21 on a single plane. The leg portions 22 are equally arranged along the periphery of the hub portion 21.

In this embodiment, the included angles between each two adjacent leg portions 22 are equal to each other, thereby decreasing the vibration when the leg portions 22 are rotating.

Furthermore, referring to FIGS. 7, 8, 11 and 13, in one embodiment, the groove 121 comprises a bottom surface 122, an end wall 123 facing the end surface of the leg portion 22, and two side walls 124 connected to two sides of the bottom surface 122.

In this embodiment, the bottom surface 122, the end wall 123, and the side walls 124 cooperatively define one of the grooves 121 for receiving the leg portion 22. The end wall 123 is usually attached to the cylinder body 11, and is arc-shaped convex towards the cylinder body 11. Accordingly, the first sides 42 are arc-shaped convex outwards along the radial direction.

When a number of leg portions 22 are involved, two adjacent leg portions 22 are smoothly connected to each other at a connecting point, to avoid the stress concentration. Then, the side walls 124 are arc-shaped convex towards the leg portions 22. The second sides 43 are arc-shaped convex towards the leg portions 22. Preferably, the side walls 124 between two adjacent leg portions 22 are smoothly connected to each other at a connecting point adjacent to the hub portion 21.

To adapt to it, the cover 4 comprises first sides 42 adjacent to the end wall 123, and further comprises two second sides 43 adjacent to the side walls 124 and connected to two opposite ends of each first side 42. The number of the pairs of second sides 43 is equal to the number of the leg portions 22. Each leg portion 22 is positioned between two second sides 43. The second sides 43 between each two adjacent leg portions 22 are smoothly connected to each other at a connecting point adjacent to the hub portion 21, thereby avoiding the stress concentration in the cover 4.

Figure 3:
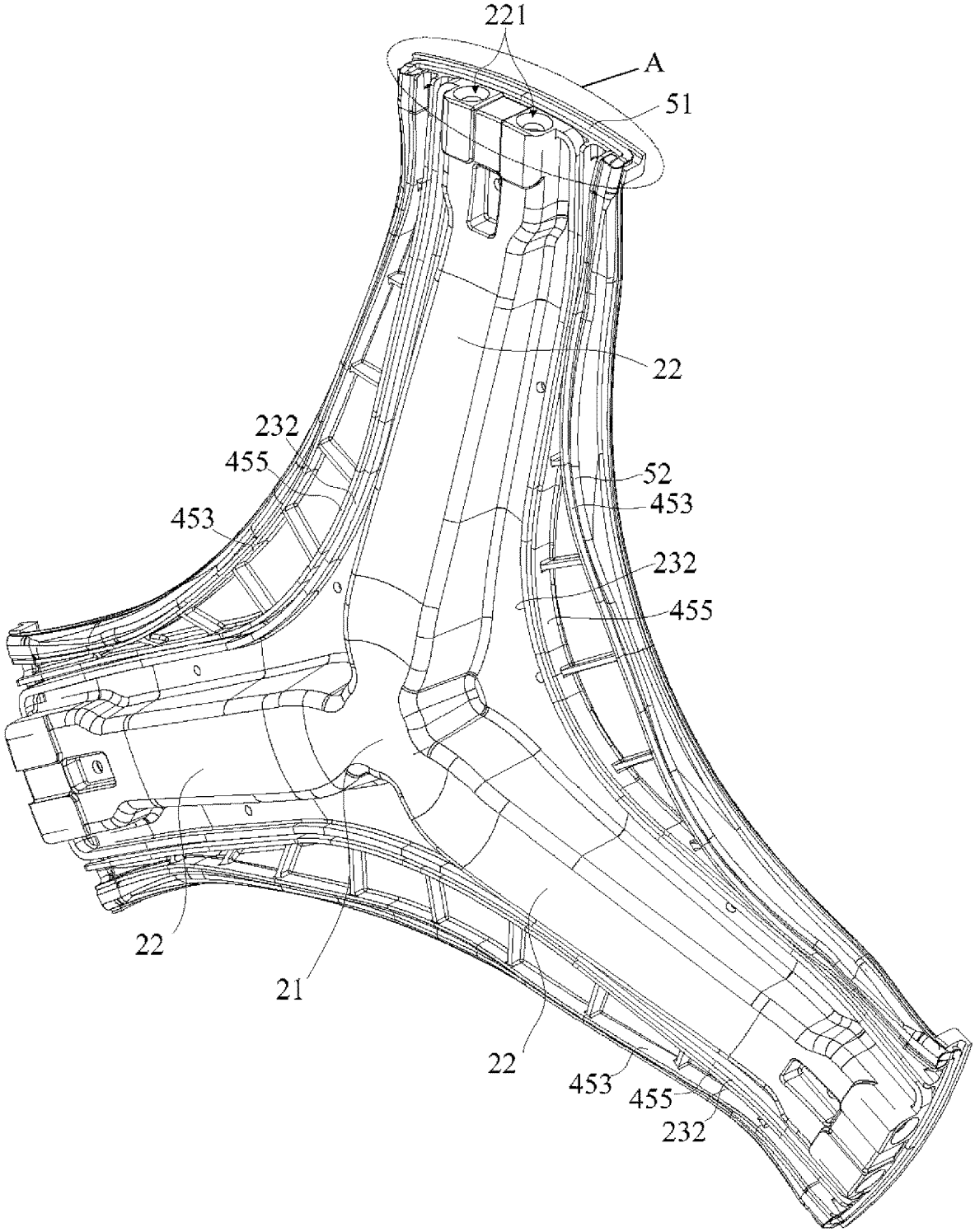
FIG. 3 is an isometric view of the washing machine inner cylinder assembly of FIG. 1, after an inner cylinder being removed.
Figure 4:
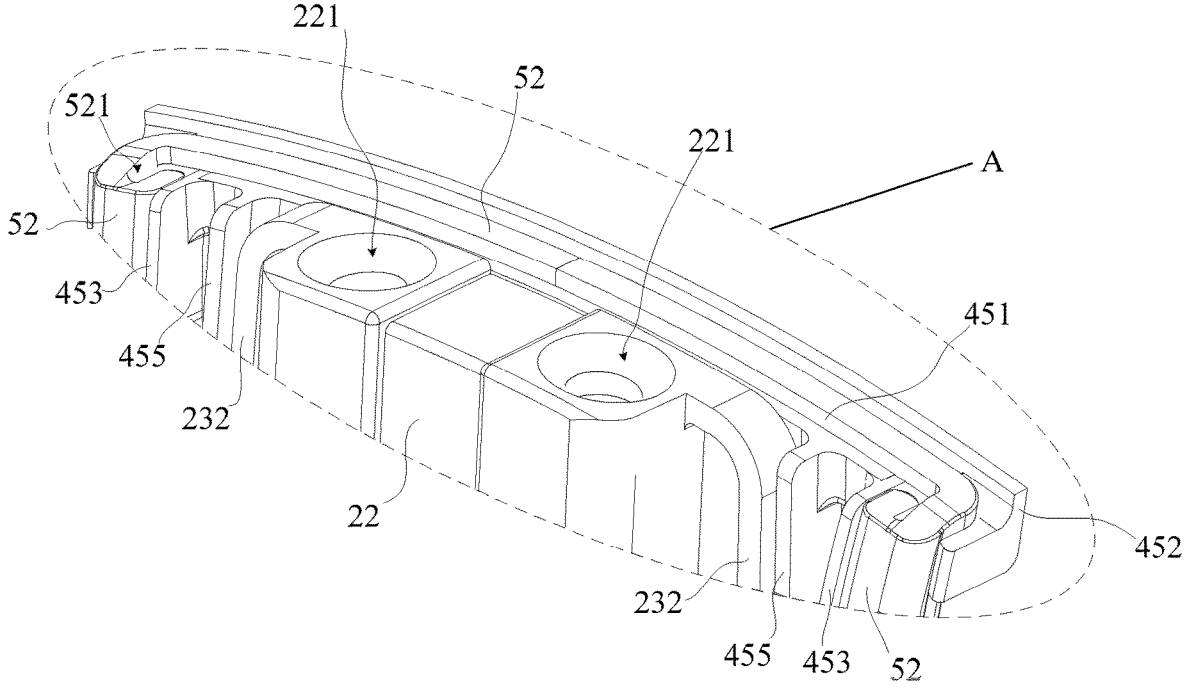
FIG. 4 is an enlarged view of a circled portion A in FIG. 3.
Figure 5:
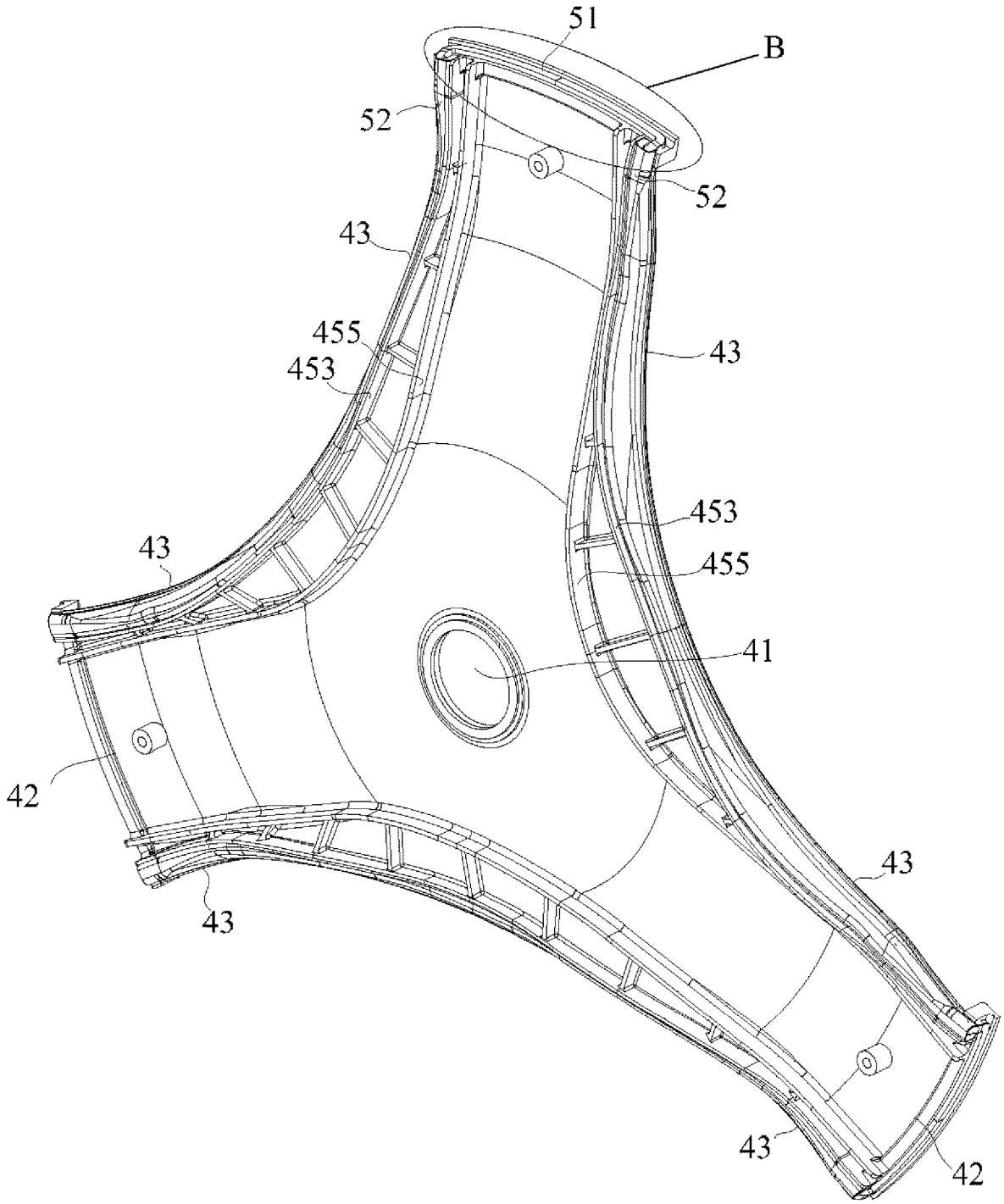
FIG. 5 is an isometric view of the washing machine inner cylinder assembly of FIG. 3, after a support being removed.
Figure 14:
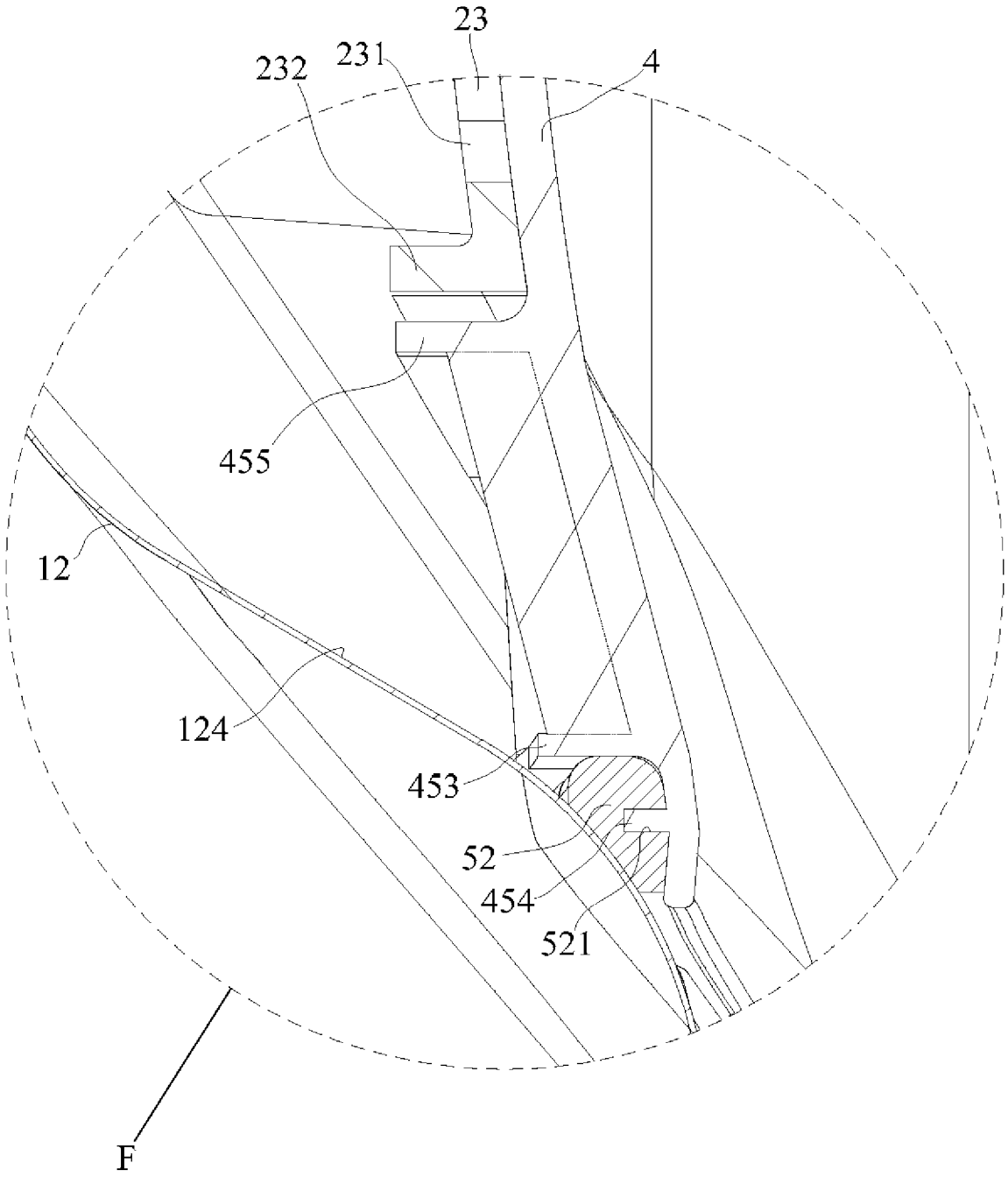
FIG. 14 is an enlarged view of a circled portion F in FIG. 12.

Furthermore, referring to FIGS. 2, 3 and 14, in one embodiment, the support 2 comprises connecting plates 23 which are arranged at a portion of the supporting 2 adjacent to the edges of the cover 4. The connecting plates 23 are used for connecting each two adjacent leg portions 22. The connecting plate 23 defines a first connecting hole 231 for connecting the cover 4.

In this embodiment, the connecting plate 23 extends from the leg portions 22 along a radial direction of the hub portion 21.

Preferably, to facilitate the assembly between the cover 4 and the support 2, the edge of the connecting plate 23 adjacent to the second sides 43 includes a flanging 232. The flanging 232 extends along the axial direction of the hub portion 21. The inner surface of the cover 4 includes positioning ribs 455 which matches the flangings 232. The support 2 is fixed between the positioning ribs 455. The positioning ribs 455 are abutted against the flangings 232.

In detail, the inner surface of the cover 4 includes a screw post (not shown) extending towards the cylinder bottom 12 and matching the first connecting hole 231. The end of the screw post adjacent to the cylinder bottom 12 defines a screw hole along the axial direction of the screw post. The screw hole is a blind hole, with an opening facing the support 2. Thus, it can prevent the cleaning agent from entering the grooves 121 through the screw hole. During assembly, the screw post is inserted into the first connecting hole 231, and then the cover 4 is connected to the support 2 by screws or flaring.

In this embodiment, the end surfaces of the leg portion 22 are connected to the end walls 123. The end surfaces of the leg portion 22 define second connecting holes 221. The end walls 123 and/or the cylinder body 11 define via holes 125 matching the second connecting holes 221.

Furthermore, the outer surface of the cover 4 is attached to the outer surface of the cylinder bottom 12. In this embodiment, the edges of the cover 4 are positioned adjacent to the outer surface of the cylinder bottom 12. The imaginary plane extending from the edges of the cover 4 is smoothly interconnected to the outer surface of the cylinder bottom 12. The connecting manner between the cover 4 and the outer surface of the cylinder bottom 12 can decrease the size of the gap between the cover 4 and the cylinder bottom 12, and can further improve the sanitary situation in the washing machine.

Furthermore, the sealing strip 5 comprises first sections 51 and second sections 52. The sealing strip 5 surrounds the outer periphery of the support 2. The first sections 51 are elastically abutted against the end walls 123. The second sections 52 are elastically abutted against the side walls 124.

In this embodiment, the first sections 51 are set along the first sides 42. The second sections 52 are set along the second sides 43. One of first sections 51 and two of the second sections 52 surrounds one leg portion 22. The sealing strip 5 generates a radially sealing force by the first section 51 and an axial sealing force by the second section 52. That is, the first section 51 can be deformed under a pressure along a radial direction to obtain sealing. The pressure can be easily generated by connection between the cylinder body 11 and the support 2, and/or between the cylinder body 11 and the cover 4. The second section 52 can be deformed under a pressure along an axial direction to obtain sealing. The pressure can be easily generated by a connection between the support 2 and the cover 4. Preferably, to be abutted against the second section 52 of the sealing strip 5, the portion of the side walls 124 adjacent to the second section 52 has a cross-section of arc-shaped convex towards the second section 52. Compared to a sealing force along a single direction, it can facilitate assembly and improve the reliability of sealing.

In this embodiment, the first connecting hole 231 is positioned adjacent to the second sides 43. Since the axial pressure applied to the second section 52 is delivered by the support 2, when the first connecting hole 231 for connecting the cover 4 is positioned adjacent to the second sides 43, deformation of the cover 4 can be decreased, thereby ensuring the reliability of sealing between the cover 4 and the second section 52.

Figure 6:
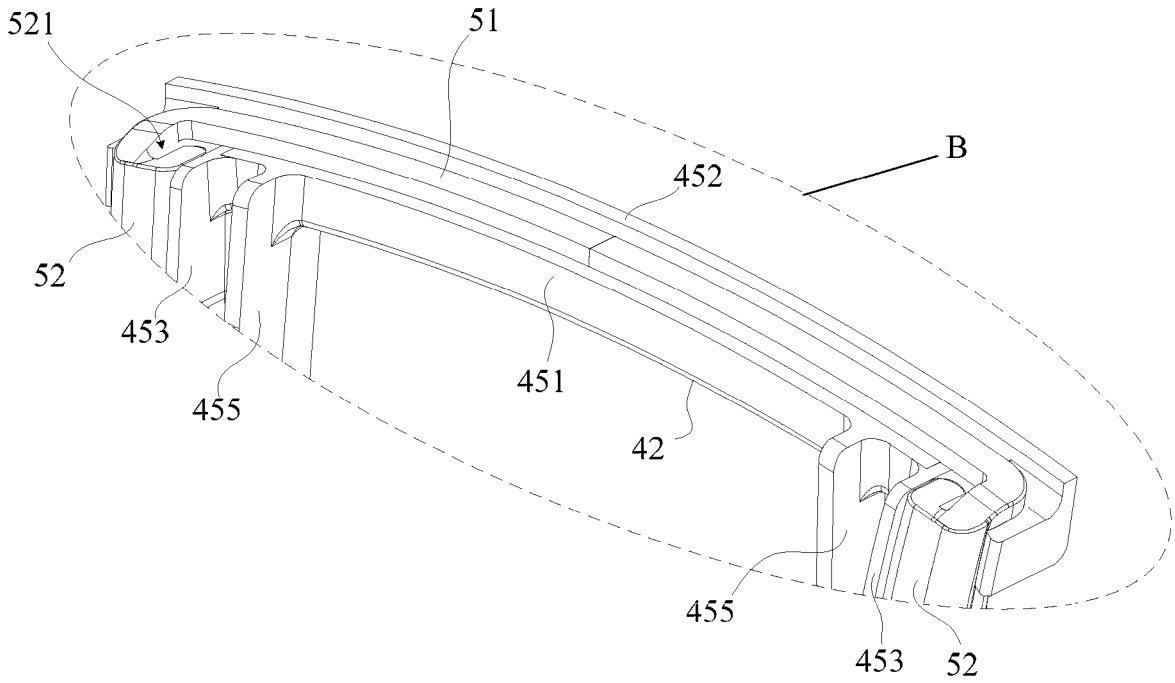
FIG. 6 is an enlarged view of a circled portion B in FIG. 5.
Figure 7:
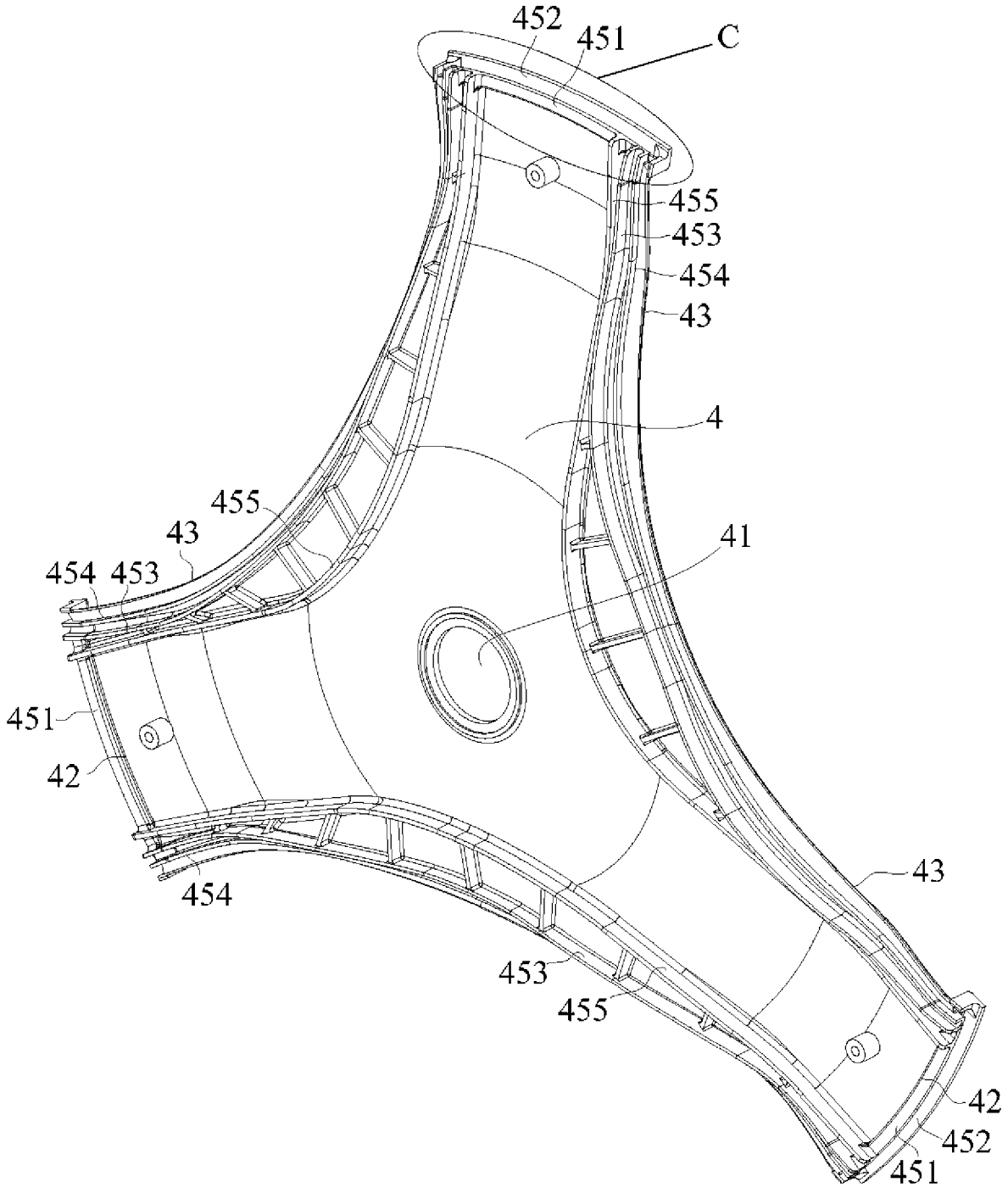
FIG. 7 is an isometric view of the washing machine inner cylinder assembly of FIG. 5, after a sealing strip being removed.
Figure 8:
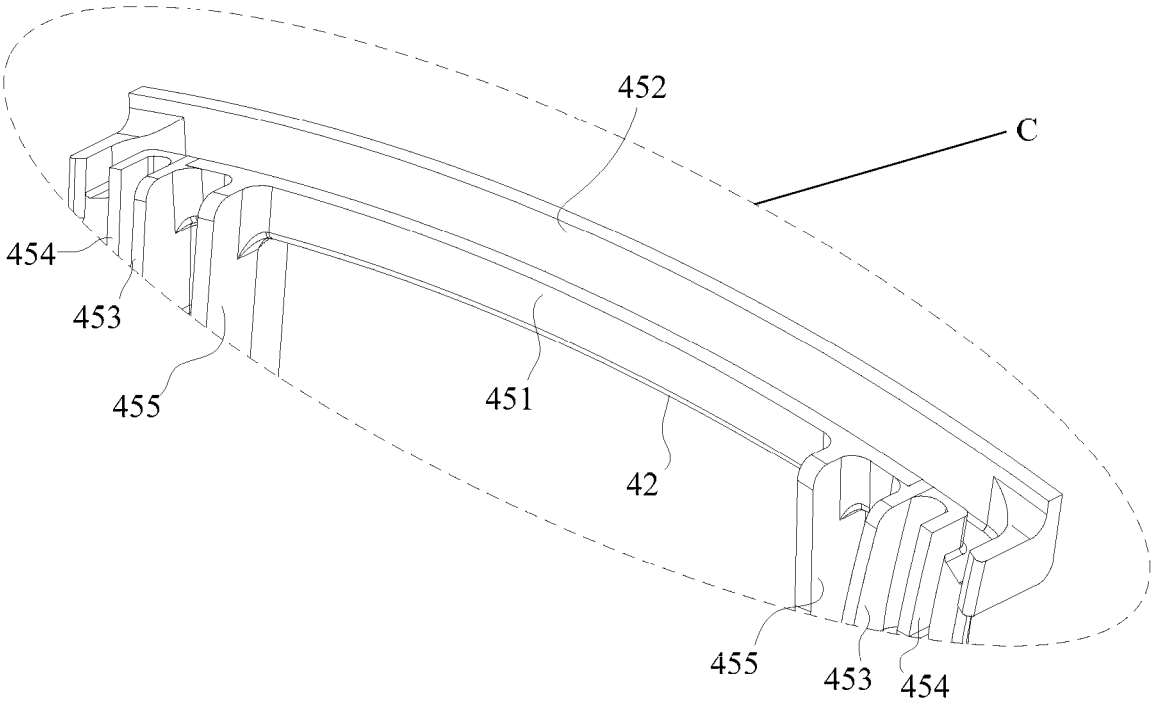
FIG. 8 is an enlarged view of a circled portion C in FIG. 5.
Figure 13:
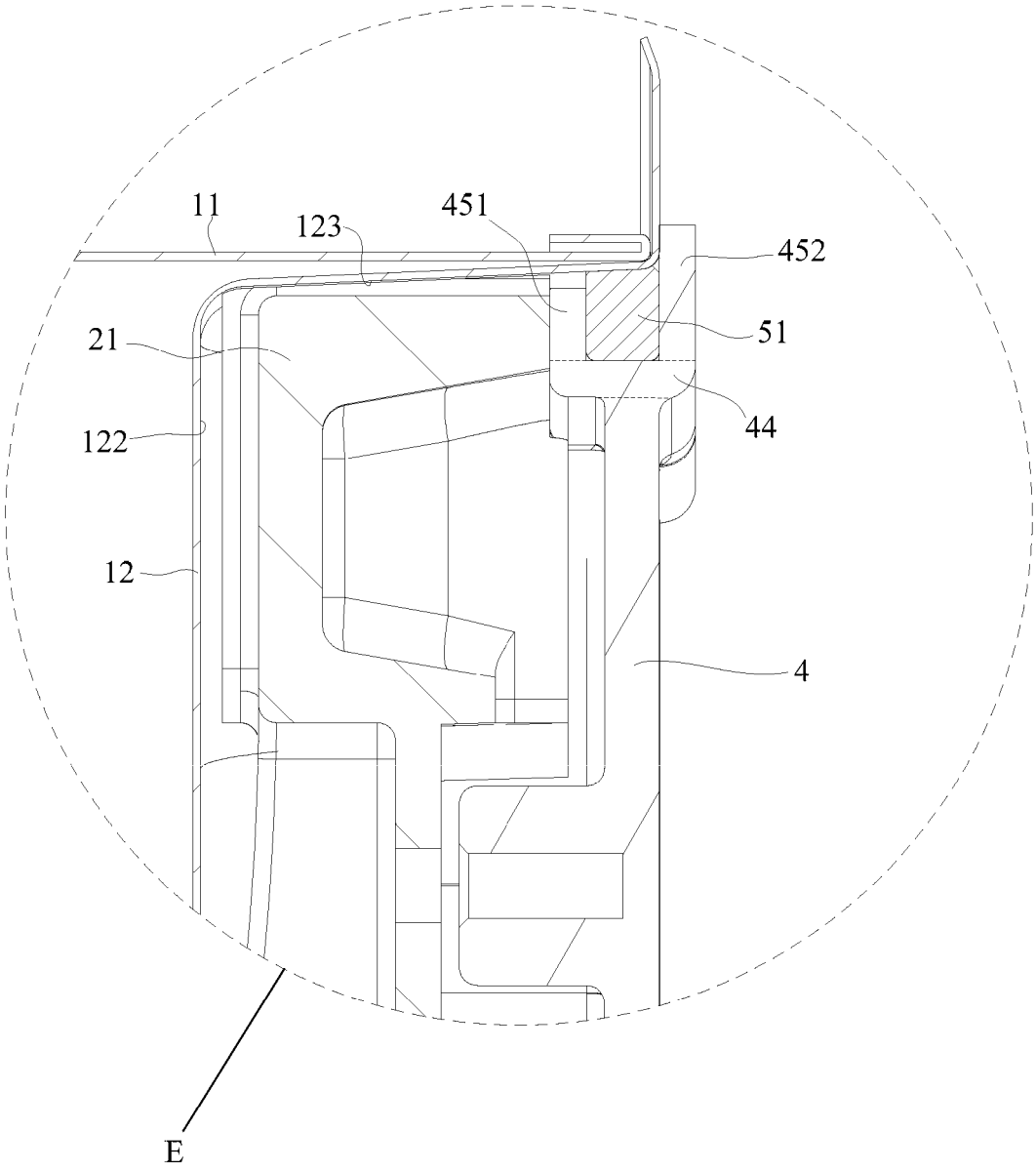
FIG. 13 is an enlarged view of a circled portion E in FIG. 12.

Furthermore, referring to FIGS. 6, 8 and 13, the edges of the cover 4 comprise top plates 44 which are bar-shaped. The top plate 44 has a lengthwise direction along the periphery of the cylinder body 11, and a width direction along the axial direction of the cylinder body 11.

A first rib 451 protrudes from the surface of the top plate 44 facing the sidewall of the cylinder body 11. The first rib 451 extends along the periphery of the cylinder body 11, and is substantially perpendicular to the top plate 44. The first section 51 is positioned between the first rib 451 and the top plate 44.

In this embodiment, the top plate 44 is positioned at the first side 42. The first rib 451 and the top plate 44 cooperatively define a stepped recess for receiving the first section 51. During assembly, the stepped recess can facilitate the position of the first section 51, to limit the position of the first section 51 along the axial direction.

Furthermore, the cover 4 further comprises a second rib 452 which is parallel to and spaced from the first rib 451. The first section 51 is clamped between the first rib 451 and the second rib 452.

In this embodiment, the first rib 451, the top plate 44, and the second rib 452 cooperatively define a U-shaped recess for receiving the first section 51. The opening of the recess faces the sidewall of the cylinder body 11. In detail, the first rib 451 is positioned adjacent to the bottom surface 122. The second rib 452 is positioned at a side of the top plate 44 facing away from the bottom surface 122. The first rib 451 and the second rib 452 can limit the first section 51 along two opposite axial directions, thereby pre-positioning the first section 51 and improve the assembling efficiency.

Furthermore, referring to FIGS. 2 and 6, in one embodiment, third ribs 453 protrude from the inner surface of the cover 4. The third ribs 453 are set along the lengthwise direction of the leg portions 22, and are spaced from the edges of the cover 4. The second section 52 is positioned between the third rib 453 and the edge of the cover 4 adjacent to the third rib 453.

In this embodiment, the third rib 453 and the edge of the cover 4 cooperatively define a stepped recess for receiving the second section 52. During assembly, the stepped recess can facilitate the position of the second section 52, to limit the position of the second section 52 along the radial direction.

Figure 9:
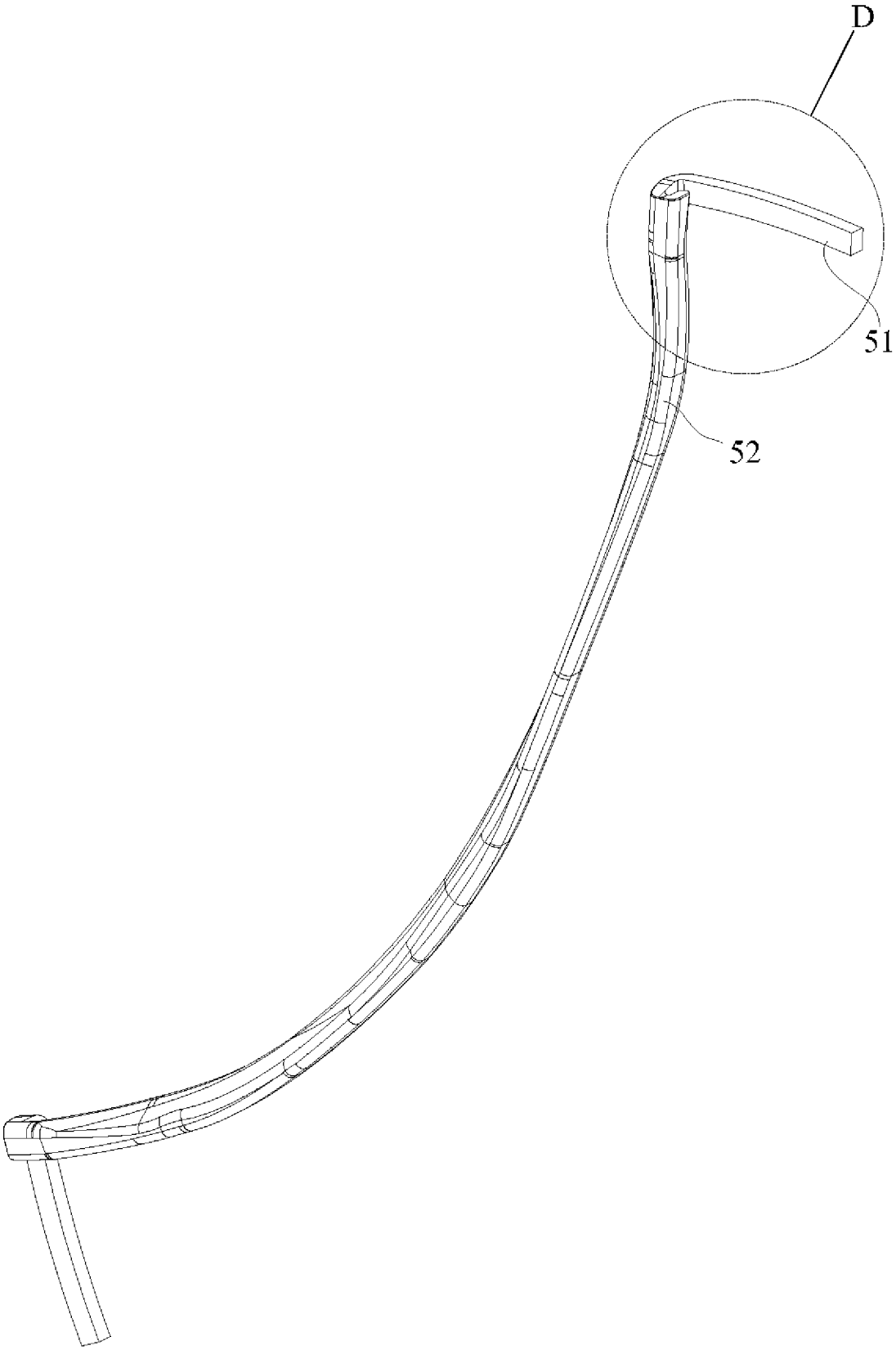
FIG. 9 is a partially isometric view of the sealing strip of FIG. 2.
Figure 10:
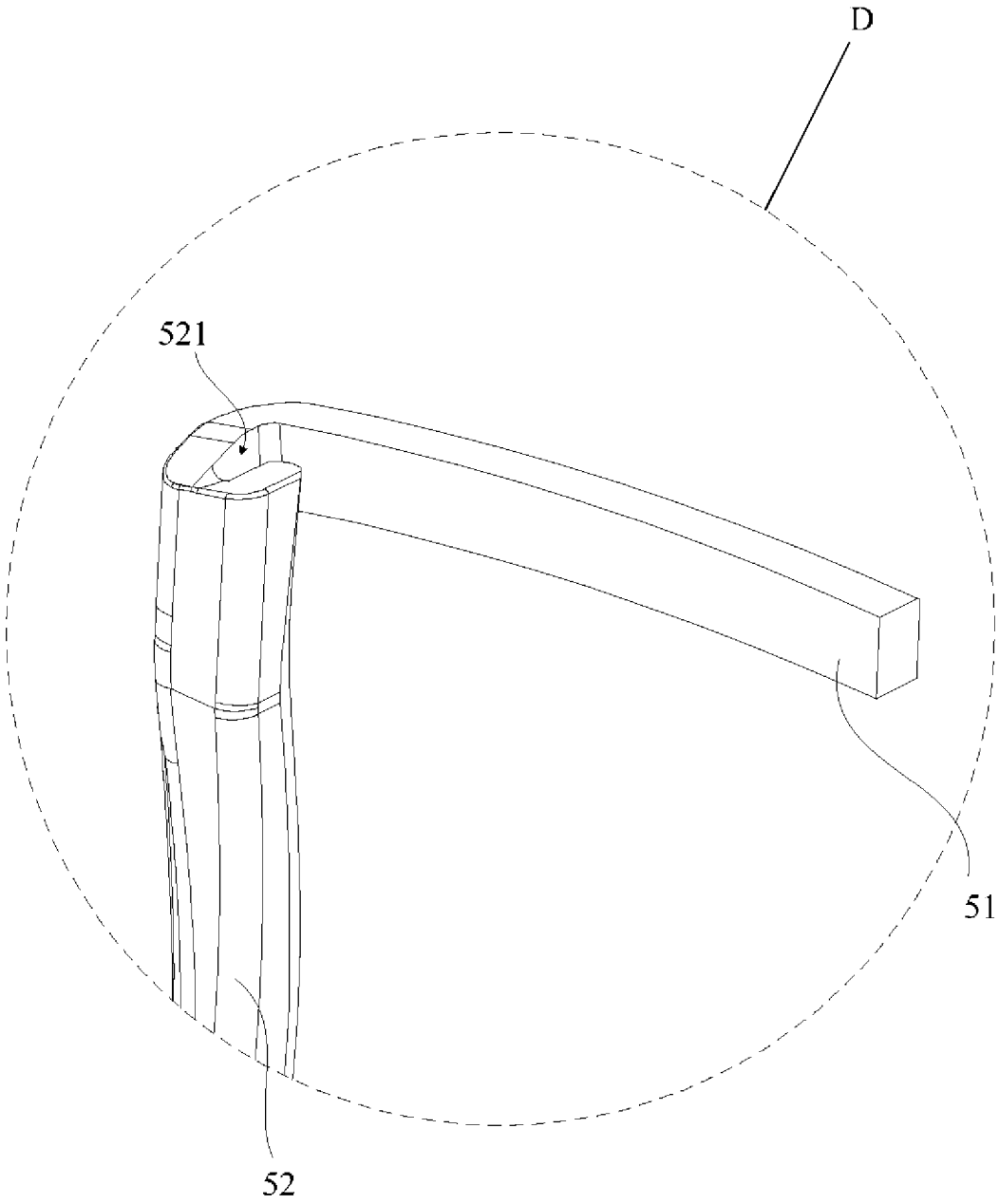
FIG. 10 is an enlarged view of a circled portion D in FIG. 9.
Figure 11:
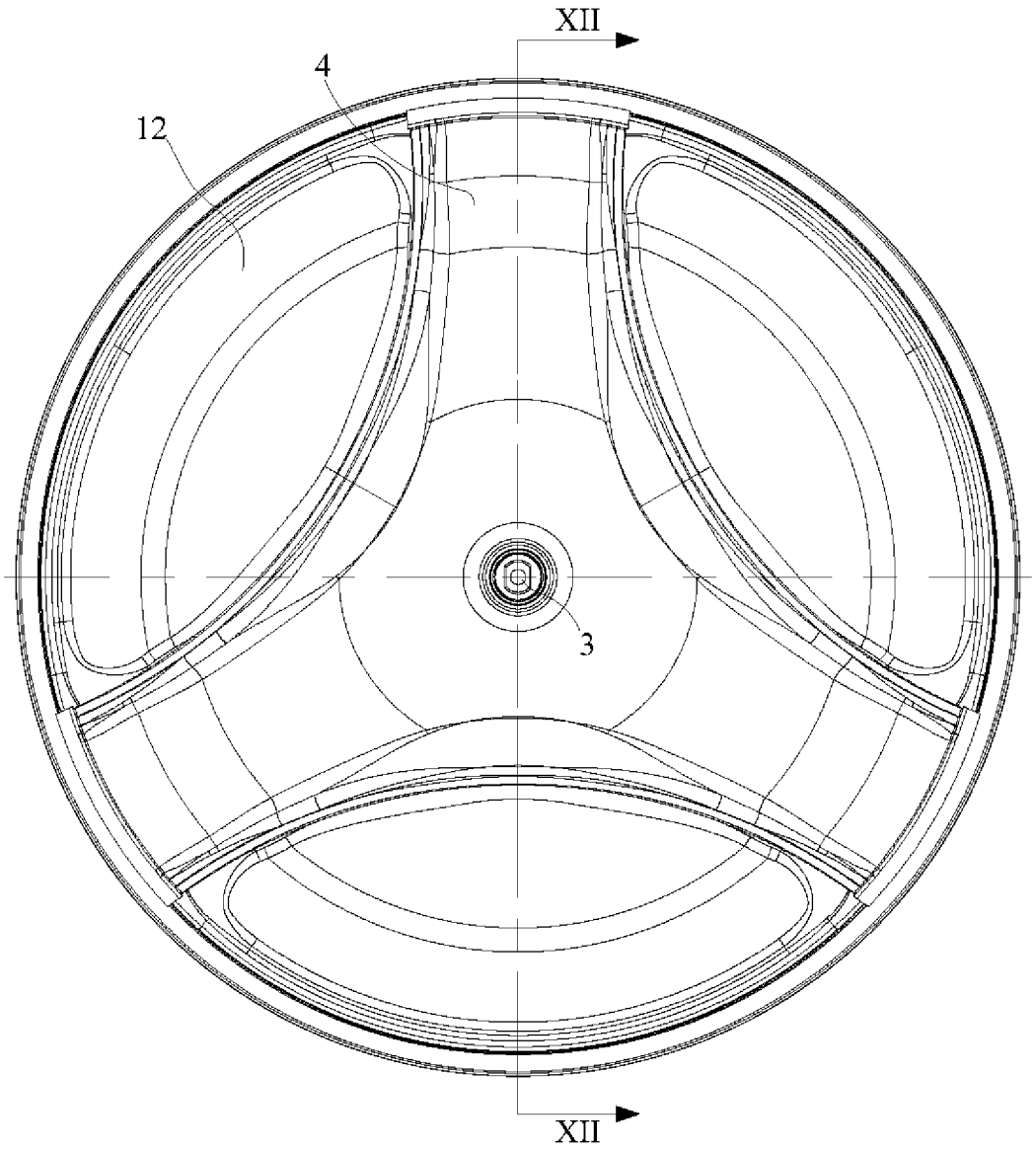
FIG. 11 is front view of the washing machine inner cylinder assembly of FIG. 1.
Figure 12:
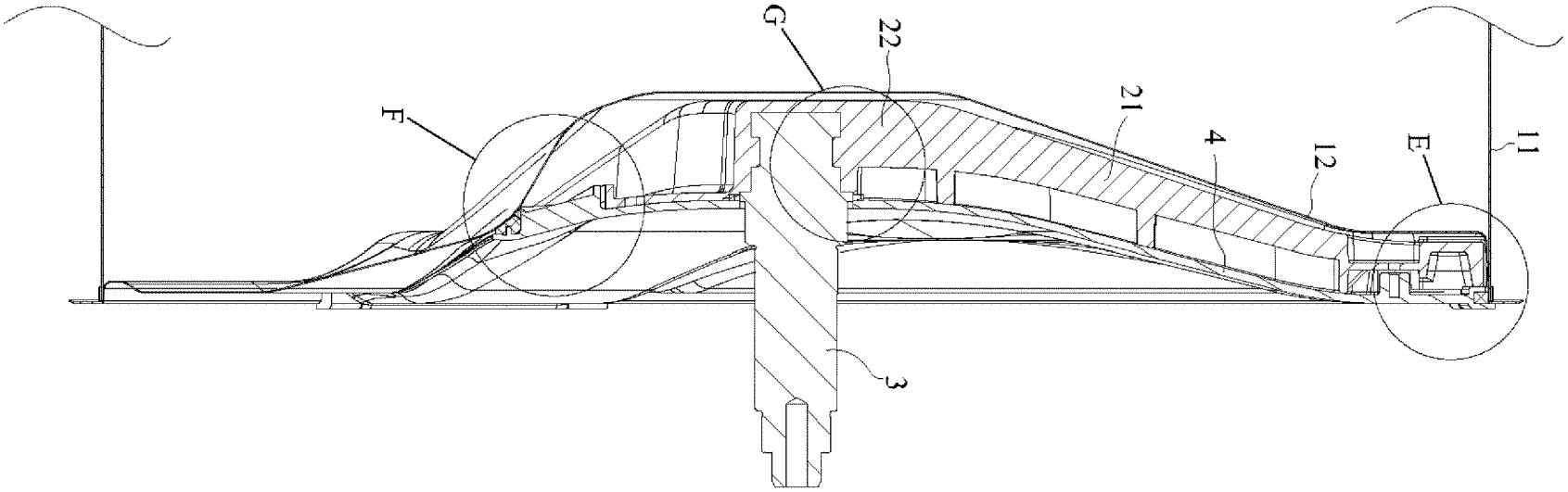
FIG. 12 is a cross-sectional view taken along line XII-XII of FIG. 11.

Furthermore, referring to FIGS. 9 and 10, in this embodiment, fourth ribs 454 protrude from the inner surface of the cover 4. The fourth ribs 454 are parallel to and spaced from the third ribs 453. The fourth rib 454 extends along the second side 43, and is positioned between the third rib 453 and the edge of the cover 4 adjacent to the third rib 453. The second section 52 defines a latching notch 521 for receiving the fourth rib 454.

In this embodiment, the fourth rib 454 is set along the second side 43, and is positioned between the third rib 453 and the second side 43. The third rib 453 and the fourth rib 454 can limit the second section 52 along two opposite radial directions, thereby pre-positioning the second section 52 and improve the assembling efficiency. Preferably, the latching notch 521 firmly engages with the fourth rib 454 to avoid loosening during assembly.

Figure 15:
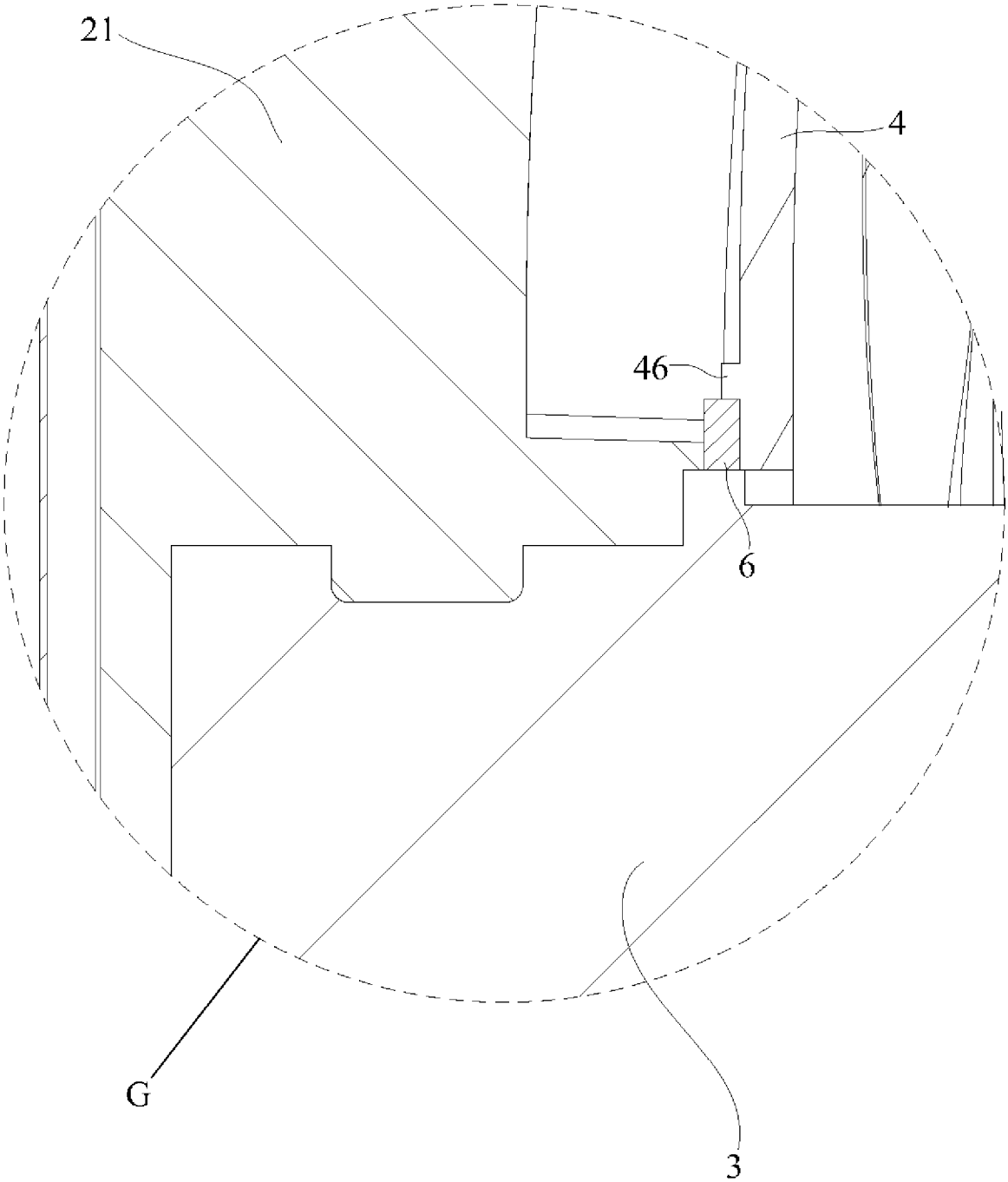
FIG. 15 is an enlarged view of a circled portion G in FIG. 12.
Figure 16:
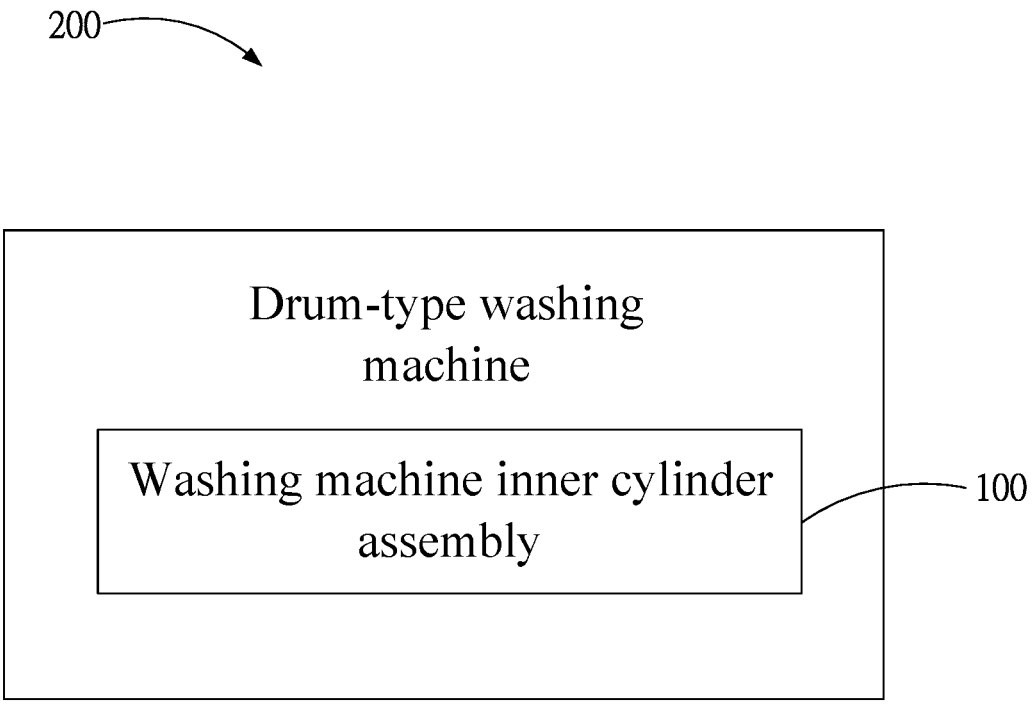
FIG. 16 is a block diagram of a drum-type washing machine including the washing machine inner cylinder assembly of FIG. 1

Furthermore, referring to FIG. 15, in one embodiment, the cover 4 defines a through hole 41 which surrounds the rotation shaft 3. The through hole 41 can match the rotation shaft 3, while sealing is obtained therebetween. The gap between the through hole 41 and the rotation shaft 3 can be sealed by filling with resin adhesive or silicon adhesive, and can also by a sealing cushion ring 6 described in the following embodiment. The washing machine inner cylinder assembly 100 further comprises the sealing cushion ring 6 around the rotation shaft 3. An annular shoulder 46 protrudes from the inner surface of the cover 4. The annular shoulder 46 surrounds the through hole 41. The sealing cushion ring 6 is elastically abutted against and positioned between the annular shoulder 46 and the outer surface of the rotation shaft 3.

In this embodiment, the rotation shaft 3 generates vibration while rotating. The sealing cushion ring 6 can accommodate the vibration, and has a low cost. The sealing strip 5 and the sealing cushion ring 6 in the above embodiments can also have a good deformation capability, and can be made of rubber or silicon.

The present disclosure further provides a drum-type washing machine 200 comprising the washing machine inner cylinder assembly 100. The structure of the washing machine inner cylinder assembly 100 is described in the above embodiments. Since the drum-type washing machine 200 employs the technical solutions of the above embodiments, the beneficial effect owing to the technical solutions of the above embodiments is not repeated again.

What described above are only preferred embodiments of the present disclosure but are not intended to limit the scope of the present disclosure. Accordingly, any equivalent structural or process flow modifications that are made on basis of the specification and the attached drawings or any direct or indirect applications in other technical fields shall also fall within the scope of the present disclosure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A washing machine inner cylinder assembly comprising:

an inner cylinder;

a support;

a rotation shaft;

a cover; and a sealing strip;

wherein the support comprises a hub portion and a leg portion extending outwards from a periphery of the hub portion, an end of the rotation shaft is fixedly embedded in a shaft hole of the hub portion;

wherein the inner cylinder comprises a cylinder body and a cylinder bottom positioned at an end of the cylinder body, a groove is defined in an outer surface of the cylinder bottom for receiving and clamping the leg portion;

wherein the cover covers the support, the sealing strip is arranged between the cover and the cylinder bottom, and the sealing strip surrounds an outer periphery of the support, the sealing strip seals between the groove and the support, the sealing strip, the cover, and the groove cooperatively define a closed space for receiving the support, and wherein the groove comprises a bottom surface, two side walls connected to the bottom surface, and an end wall facing an end surface of the leg portion;

the sealing strip comprises first sections and second sections, wherein the first section is elastically abutted against the end wall, and the second section is elastically abutted against the side walls.

2. The washing machine inner cylinder assembly of claim 1, wherein edges of the cover comprise top plates which are bar-shaped, each of the top plates have a lengthwise direction along a periphery of the cylinder body, and a width direction along the axial direction of the cylinder body, a first rib protrudes from a surface of each top plate facing a sidewall of the cylinder body, the first rib extends along the periphery of the cylinder body, and the first section is positioned between the first rib and each top plate.

3. The washing machine inner cylinder assembly of claim 2, wherein the cover further comprises a second rib which is parallel to and spaced from the first rib, and the first section is clamped between the first rib and the second rib.

4. The washing machine inner cylinder assembly of claim 1, wherein third ribs protrude from an inner surface of the cover, the third ribs are set along a lengthwise direction of the leg portions, and are spaced from edges of the cover, and the second section is positioned between the third rib and the edge of the cover adjacent to the third rib.

5. The washing machine inner cylinder assembly of claim 4, wherein fourth ribs protrude from the inner surface of the cover, the fourth ribs are parallel to and spaced from the third ribs, the fourth rib is positioned between the third rib and the edge of the cover, and the second section defines a latching notch for receiving the fourth rib.

6. The washing machine inner cylinder assembly of claim 1, wherein the cover defines a through hole which surrounds the rotation shaft, the through hole matches the rotation shaft while sealing is obtained therebetween, the washing machine inner cylinder assembly further comprises a sealing cushion ring around the rotation shaft, an annular shoulder protrudes from an inner surface of the cover, and the sealing cushion ring is elastically abutted against and positioned between the annular shoulder and an outer surface of the rotation shaft.

7. A drum-type washing machine comprising:

a washing machine inner cylinder assembly comprising:

an inner cylinder;

a support;

a rotation shaft;

a cover; and a sealing strip;

wherein the support comprises a hub portion and a leg portion extending outwards from a periphery of the hub portion, an end of the rotation shaft is fixedly embedded in a shaft hole of the hub portion;

wherein the inner cylinder comprises a cylinder body and a cylinder bottom positioned at an end of the cylinder body, a groove is defined in an outer surface of the cylinder bottom for receiving and clamping the leg portion;

wherein the cover covers the support, the sealing strip is arranged between the cover and the cylinder bottom, and the sealing strip surrounds outer periphery of the support, the sealing strip seals between the groove and the support, the sealing strip, the cover, and the groove cooperatively define a closed space for receiving the support, and wherein the groove comprises a bottom surface, two side walls connected to the bottom surface, and an end wall facing an end surface of the leg portion;

the sealing strip comprises first sections and second sections, the first section is elastically abutted against the end wall, and the second section is elastically abutted against the side walls.

8. The drum-type washing machine of claim 7, wherein edges of the cover comprise top plates which are bar-shaped, each of the top plates have a lengthwise direction along a periphery of the cylinder body, and a width direction along the axial direction of the cylinder body, a first rib protrudes from a surface of each top plate facing a sidewall of the cylinder body, the first rib extends along the periphery of the cylinder body, and the first section is positioned between the first rib and each top plate.

9. The drum-type washing machine of claim 8, wherein the cover further comprises a second rib which is parallel to and spaced from the first rib, and the first section is clamped between the first rib and the second rib.

10. The drum-type washing machine of claim 7, wherein the cover defines a through hole which surrounds the rotation shaft, the through hole matches the rotation shaft while sealing is obtained therebetween, the washing machine inner cylinder assembly further comprises a sealing cushion ring around the rotation shaft, an annular shoulder protrudes from an inner surface of the cover, and the sealing cushion ring is elastically abutted against and positioned between the annular shoulder and an outer surface of the rotation shaft.

* * * * *